United States Patent [19]

Gronbach

[11] 4,015,309

[45] Apr. 5, 1977

[54] HINGE WITH COMPRESSIONS SPRING FOR COUNTER-BALANCING WEIGHT OF LEAVES

[76] Inventor: Wilhelm Gronbach, Dr.
Fritz-Huber-Str. 73, 8090
Wasserburg,Inn, Germany

[22] Filed: Nov. 20, 1975

[21] Appl. No.: 633,611

[30] Foreign Application Priority Data

Nov. 22, 1974 Germany ..... 2455419

[52] U.S. Cl. ..... 16/190; 16/85

[51] Int. Cl.[2] ..... E05F 1/12

[58] Field of Search ..... 16/85, 190, 1 C, 141, 16/142, 145

[56] References Cited

UNITED STATES PATENTS

| | | | |
|---|---|---|---|
| 3,187,374 | 6/1965 | Lundell | 16/190 |
| 3,714,680 | 2/1973 | Little | 16/85 |
| 3,737,947 | 6/1973 | Little | 16/190 |
| 3,766,600 | 10/1973 | Little | 16/85 |

FOREIGN PATENTS OR APPLICATIONS

| | | | |
|---|---|---|---|
| 304,456 | 9/1968 | Sweden | 16/190 |

*Primary Examiner*—Andrew V. Kundrat
*Attorney, Agent, or Firm*—Fleit & Jacobson

[57] ABSTRACT

A spring-biased hinge for the weight compensation of two structural members that are to be pivotably interconnected by means of the hinge for pivotal motion about a horizontal axis, particularly for counter-balancing the weight of a lid pivotable with respect to a freezer chest, comprises first and second hinge members pivotally interconnected by a hinge pin and securable one to each of the structural members. A precompressed spring is supported at one end by the first hinge member and at its other end by a guide rod for the spring. The guide rod is axially displaceable and acts on the second hinge member. At its said one end, the spring is supported by means of a cradle member which can rock on a bearing edge provided on the first hinge member, brake shoes for acting on the guide rod being interposed between said one end of the spring and the cradle member.

5 Claims, 4 Drawing Figures

HINGE WITH COMPRESSIONS SPRING FOR COUNTER-BALANCING WEIGHT OF LEAVES

The invention relates to a hinge with compression spring for counter-balancing the weight of leaves, e.g. covers, flaps or the like that are pivotable about a horizontal axis, particularly on freezer chests, wherein one end of the compression spring supports itself in the fixed hinged portion with prestressing and its other end, by way of the end of a guide rod supporting the compression spring, engages the second hinge portion that is attached to the leaf, and wherein the guide rod for the spring is supported at its lower end, through the interposition of a rocker, on a knife bearing of the fixed hinge portion.

A hinge of this type is known from DT-PS No. 1,708,350, wherein the upper end of the guide rod for the spring carries a slide block of polyacetal resin or a similarly effective material which is guided with the aid of a cam which is disposed directly in the hinge portion attached to the leaf and which is divided into a control cam and a post-stressing cam. Such a hinge is so designed that it functions to counterbalance the cosine course of the cover torque over the entire path of the opening movement. To achieve counter-balancing, the force and characteristic of the spring must be adapted to the cover torque within fairly close limits. For this reason various springs are required, e.g. at intervals of 1 mkg of the cover torque. For example, for three sizes of freezer chests of which the covers have a maximum torque of 6.5 mkg, 5.5 mkg and 4.5 mkg, respectively, hinges with three different spring strengths or spring characteristics are required.

The invention is based on the object of improving a hinge of the aforementioned kind so that a braking effect is produced on actuation of the leaf.

The subject of an older right (No. P 23 27 397.9-23) is the achievement of this object such that the end of the guide rod opposite the slide block is provided with a coarse pitch screwthread and that a coarse pitch nut in which the lower end of the guide rod is guided is placed on the rocker. A hinge according to the older right has the advantage that a spring associated with a maximum torque of for example 6.5 mkg can still be used if the cover that is to be counter-balanced has a maximum torque of 4 mkg. Since the cover torques in question can thus be controlled with a number of springs that is reduced to one third, a smaller stock of springs is required by the manufacturer and a smaller stock of hinges is required by the purchaser. Further, there will no longer be a need for adapting the prestressing of the spring with the aid of an adjusting screw to the torque of the cover as is the case during assembly of the hinge according to the older right. The braking effect when actuating the leaf instead prevents the acceleration thereof, even if the spring used in the hinge is associated with a larger maximum torque than that possessed by the cover to be counter-balanced.

The subject of the present invention is a further solution of the set problem. In a hinge of the aforementioned kind, the solution consists in that brake jaws disposed between the end of the guide rod supporting the compression spring and the associated end of the compression spring. The hinge according to the invention has all the advantages of a hinge according to the older right. Nevertheless, it can be made from fewer structural parts. In particular, the need is avoided for providing the guide rod for the spring with a coarse pitch screwthread which has to be rolled in in a special manufacturing operation. Also, in the hinge according to the invention the brake force changes automatically with the spring force.

Various examples of the invention will be described in the following description. In the drawings.

Figure 1:
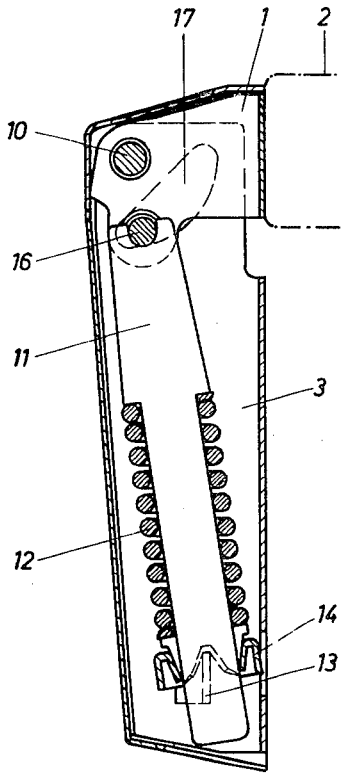
FIG. 1 is a section through an embodiment of a hinge according to the invention.

In all embodiments, the hinge consists of a hinge portion 1 fixed to the leaf 2 and a fixed hinge portion 3 fixed to the lower portion of, for example, a freezer chest. The hinge portion 3 has the form of a U-shaped housing of which the side remote from the freezer chest is open. Attachment to the freezer chest is effected by way of apertures 4, 5. The movable leaf hinge portion 1 is fixed to the leaf 2 by way of holes 6 to 9. It will be readily evident from the pictorial representation in FIG. 2 that the holes necessary for the attachment are exposed even if the hinge is already pre-assembled, so that the attachment to the lower portion and the cover of the freezer chest can be effected simply and rapidly.

The two hinge portions are pivotably interconnected by means of a hinge pin 10.

The guide rod 11 for the spring is mounted in the fixed hinge portion 3 at a spacing from the hinge point at its other end that is independent of the prestressing of the spring 12. In the illustrated example a knife bearing 13 is provided. A rocker 14 lies on the knife bearing 13.

At the end facing the hinge pin 10, the guide rod 11 for the spring is guided in bifurcated manner in a machined groove 15 of a pivot pin 16. This pivot and bearing pin 16 has each end engaged in a recess 17 in the opposed faces of the U-shaped housing of the fixed hinge portion 3, which recess determines the two end positions of the hinge by reason of its shape.

The hinge pin 10 is guided in a bearing sleeve 19 between the holes 6, 8 or 7, 9 of the fixing lug 18.

Figure 2:
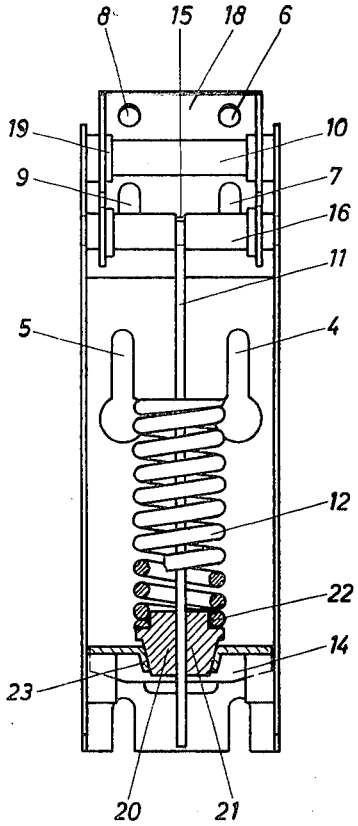
FIG. 2 is an elevation of said embodiment viewed from the open side of the hinge housing.

In all embodiments, two brake jaws 20, 21 or 24, 25 or 27, 28 of polyacetal are disposed between the other end of the guide rod 11 for the spring and the associated end of the compression spring 12. In the embodiment of FIGS. 1 and 2, the brake jaws 20, 21 are provided with a guide 22 for the compression spring 12 at the side facing the compression spring. At the side facing the rocker 14, the brake jaws 20, 21 are conical. The rocker 14 is similarly provided with a hole 23 of a complementary conical shape.

From the foregoing description of the construction it will be understood that the brake force changes automatically with the spring force because, the stronger the spring pressure, the more will the brake jaws 20, 21 be pressed into the conical hole 23 of the rocker 14.

The guide rod 11 for the spring need not be of flat construction but could also be round.

Figure 3:
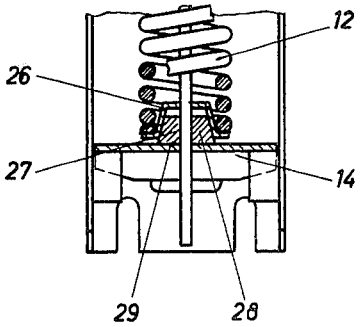
FIG. 3 is an elevation corresponding to FIG. 2 of a second embodiment.

In the embodiment of FIG. 3, the brake jaws 27, 28 are conical towards the compression spring 12. They support themselves on the rocker 14 with a planar face 29. Between the compression spring 12 and the facing cone of the brake jaws 27, 28 there is a metal plate 26 of complementary concial form. The end of the compression spring 12 facing the rocker 14 is therefore supported by means of the metal plate 26 on the brake jaws 27, 28 which, in turn, are supported on the rocker 14. The metal plate 26 therefore serves as a mounting for the compression spring 12 as well as for the brake jaws 27, 28.

Figure 4:
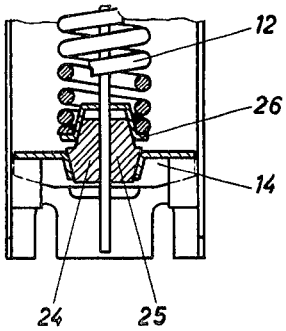
FIG. 4 is an elevation corresponding to FIG. 2 of a third embodiment.

FIG. 4 illustrates brake jaws 24, 25 of which the shape is obtained by replacing the guide member 22 in the FIG. 2 embodiment with a construction of the brake jaws 27, 28 in accordance with FIG. 3 and each of these brake jaws is made in one piece. This results in brake jaws with a double cone, as will be readily evident from FIG. 4. The support of the brake jaws 24, 25 within the rocker 14 corresponds to the FIG. 2 embodiment. With regard to the interpositioning of the metal plate 26, the construction corresponds to the FIG. 3 embodiment.

The embodiment just described is particularly favourable if a high braking force is required because the braking jaws are then enclosed about their entire periphery so that the force emanating from the compression spring 12 is almost entirely transmitted to the brake jaws 24, 25 which come to lie against the guide rod 11 for the spring.

I claim:

1. A hinge with compression spring for counterbalancing the weight of leaves, e.g. covers, flaps or the like that are pivotable about a horizontal axis, particularly on freezer chests, wherein one end of the compression spring supports itself in the fixed hinged portion with the prestressing and its other end, by way of the end of a guide rod supporting the compression spring, engages the second hinge portion that is attached to the leaf, wherein the guide rod for the spring is supported at its lower end, through the interposition of a rocker, on a knife bearing of the fixed hinged portion, wherein brake jaws are disposed between the end of the guide rod supporting the compression spring and the associated end of the compression spring, said brake jaws being in the form of a double cone, one cone being at the side facing the rocker and guided in a complementary conical hole of the rocker and the other cone facing the compression spring.

2. A hinge according to claim 1 further comprising a complementary conical plate between the compression spring and the facing cone of the brake jaws there is arranged a complementary conical place, preferably of metal.

3. A hinge according to claim 1, wherein the brake jaws are made from a thermoplastic material, preferably from polyacetal resin.

4. A hinge according to claim 1, wherein the other end of the guide rod for the spring is bifurcated and guided in a machined groove of a pivot pin.

5. A hinge with compression spring for counterbalancing the weight of leaves, e.g. covers, flaps or the like that are pivotable about a horizontal axis, particularly on freezer chests, wherein one end of the compression spring supports itself in the fixed hinged portion with prestressing and its other end, by way of the end of a guide rod supporting the compression spring, engages the second hinge portion that is attached to the leaf, wherein the guide rod for the spring is supported at its lower end, through the interposition of a rocker, on a knife bearing of the fixed hinged portion wherein brake jaws are disposed between the end of the guide rod supporting the compression spring and the associated end of the compression spring, said brake jaws being conical towards the compression spring and support themselves with a planar face.

* * * * *